US008974109B2

(12) United States Patent
Gauvin et al.

(10) Patent No.: US 8,974,109 B2
(45) Date of Patent: Mar. 10, 2015

(54) BLENDING SCALE

(75) Inventors: Frédéric Gauvin, Rivière-du-Loup (CA); Martin Morin, Rivière-du-Loup (CA); Patrick Dumont, St-Antonin (CA); Michaël Landry, Le Bic (CA); Damon M. Palmer, Pittsboro, IN (US)

(73) Assignee: Premier Tech Technologies Ltée, Quebec (CA)

( * ) Notice: Subject to any disclaimer, the term of this patent is extended or adjusted under 35 U.S.C. 154(b) by 49 days.

(21) Appl. No.: 13/030,744

(22) Filed: Feb. 18, 2011

(65) Prior Publication Data

US 2012/0026824 A1 Feb. 2, 2012

Related U.S. Application Data

(60) Provisional application No. 61/368,278, filed on Jul. 28, 2010.

(51) Int. Cl.
*B01F 3/18* (2006.01)
*B01F 5/24* (2006.01)
*B01F 15/04* (2006.01)

(52) U.S. Cl.
CPC . *B01F 3/18* (2013.01); *B01F 5/241* (2013.01); *B01F 15/0445* (2013.01)
USPC ..... 366/141; 366/152.1; 366/152.2

(58) Field of Classification Search
CPC ..... B01F 3/18
USPC ..... 366/141, 152.1, 152.2; 700/265
See application file for complete search history.

(56) References Cited

U.S. PATENT DOCUMENTS

| | | | | |
|---|---|---|---|---|
| 2,512,214 | A * | 6/1950 | Riza | 366/157.3 |
| 3,091,369 | A * | 5/1963 | Sackett, Sr. | 222/77 |
| 3,172,491 | A * | 3/1965 | Mainey | 177/120 |
| 3,186,596 | A * | 6/1965 | Badgett | 222/14 |
| 3,574,344 | A * | 4/1971 | Wallace | 366/132 |
| 3,603,567 | A * | 9/1971 | Sackett, Sr. | 366/141 |
| 3,638,916 | A * | 2/1972 | Ursic et al. | 366/132 |
| 4,222,448 | A * | 9/1980 | Sunkle et al. | 177/1 |

(Continued)

FOREIGN PATENT DOCUMENTS

WO WO 2009071133 A1 * 6/2009

*Primary Examiner* — David Sorkin
*Assistant Examiner* — Abbas Rashid
(74) *Attorney, Agent, or Firm* — Sutherland Asbill & Brennan LLP

(57) ABSTRACT

A blending scale for dosing and blending two products. The blending scale includes an auxiliary product dosing device, and an auxiliary product dispenser receiving the auxiliary product from the auxiliary product dosing device and releasing the auxiliary product within a dynamic unconstrained stream of the main product to produce and maximize a blend of the auxiliary and main products. A blend collector measures a quantity of the blend of the auxiliary and main products. A controller controls release of the auxiliary product in a synchronized manner with the dynamic unconstrained stream of the main product, based on the defined quantity of the auxiliary product measured by the auxiliary product dosing device. The dynamic stream of the main product is terminated once a targeted quantity of the blend measured by the blend collector is obtained. A method for accurately dosing and homogeneously blending two products is also disclosed.

26 Claims, 8 Drawing Sheets

(56) References Cited

U.S. PATENT DOCUMENTS

| | | | | | |
|---|---|---|---|---|---|
| 4,259,022 | A | * | 3/1981 | Folland | 366/152.2 |
| 4,334,784 | A | * | 6/1982 | Engels | 366/76.3 |
| 4,353,482 | A | * | 10/1982 | Tomlinson et al. | 222/1 |
| 4,358,205 | A | * | 11/1982 | Eakins | 366/141 |
| 4,459,028 | A | * | 7/1984 | Bruder et al. | 366/141 |
| 4,520,651 | A | * | 6/1985 | Litman | 73/23.34 |
| 4,544,279 | A | * | 10/1985 | Rudolph | 366/132 |
| 4,581,704 | A | * | 4/1986 | Mitsukawa | 700/239 |
| 4,733,971 | A | * | 3/1988 | Pratt | 366/141 |
| 4,786,182 | A | * | 11/1988 | Larsen | 366/140 |
| 4,830,508 | A | * | 5/1989 | Higuchi et al. | 366/141 |
| 4,836,685 | A | * | 6/1989 | Verreault | 366/141 |
| 4,876,653 | A | * | 10/1989 | McSpadden et al. | 700/239 |
| 4,889,433 | A | * | 12/1989 | Pratt | 366/141 |
| 5,014,889 | A | * | 5/1991 | Hayashi | 222/644 |
| 5,110,521 | A | * | 5/1992 | Moller | 264/40.4 |
| 5,148,943 | A | * | 9/1992 | Moller | 222/1 |
| 5,240,324 | A | * | 8/1993 | Phillips et al. | 366/132 |
| 5,340,211 | A | * | 8/1994 | Pratt | 366/141 |
| 5,431,201 | A | * | 7/1995 | Torchia et al. | 141/98 |
| 5,627,346 | A | * | 5/1997 | Weibel et al. | 177/64 |
| 5,674,005 | A | * | 10/1997 | Corey et al. | 366/132 |
| 5,796,330 | A | * | 8/1998 | Vinette | 340/426.26 |
| 6,057,514 | A | * | 5/2000 | Maguire | 177/105 |
| 6,098,847 | A | * | 8/2000 | Vollmar | 222/142 |
| 6,120,172 | A | * | 9/2000 | Chen et al. | 366/8 |
| 6,120,173 | A | * | 9/2000 | Bonissone et al. | 366/8 |
| 6,155,709 | A | * | 12/2000 | O'Callaghan | 366/141 |
| 6,188,936 | B1 | * | 2/2001 | Maguire et al. | 700/265 |
| 6,253,779 | B1 | * | 7/2001 | Nanaji et al. | 137/3 |
| 6,832,133 | B1 | * | 12/2004 | Belloli | 700/265 |
| 7,137,729 | B2 | | 11/2006 | Moretto | |
| 7,211,746 | B2 | * | 5/2007 | Goble | 177/90 |
| 7,308,339 | B2 | * | 12/2007 | Bonissone et al. | 700/265 |
| 7,572,048 | B2 | * | 8/2009 | Morey et al. | 366/16 |
| 2003/0185094 | A1 | * | 10/2003 | Packard | 366/141 |
| 2007/0110872 | A1 | * | 5/2007 | Gerber | 426/565 |
| 2007/0251596 | A1 | * | 11/2007 | Scherzer et al. | 141/2 |
| 2008/0267004 | A1 | * | 10/2008 | Deters et al. | 366/141 |
| 2009/0027995 | A1 | * | 1/2009 | Bachman et al. | 366/132 |
| 2010/0247702 | A1 | * | 9/2010 | Ben Lulu | 425/255 |
| 2011/0035040 | A1 | * | 2/2011 | Ihme et al. | 700/103 |
| 2011/0041712 | A1 | * | 2/2011 | Ihme | 101/171 |
| 2011/0041952 | A1 | * | 2/2011 | Gaultney | 141/83 |

* cited by examiner

BLENDING SCALE

RELATED APPLICATION

This application claims the benefit of U.S. Provisional Application No. 61/368,278, filed on Jul. 28, 2010 and entitled "Blending Scale".

The above patent application is incorporated herein by reference in its entirety.

FIELD OF THE INVENTION

The present invention generally relates to packaging systems. More particularly, the present invention relates to a blending scale that accurately doses and homogeneously blends at least two types of granular and flowable products.

BACKGROUND OF THE INVENTION

In various types of industry, several bagged products are composed of a mixture of 2 or more products. This is the case, among others, of certain animal foods, potting mixes, concrete mixtures, etc. In the cited examples, the importance of the homogeneity of the mixture and the proportions or quantities of each product is relatively low (usually not regulated or standardized). In some other cases, there is a need to homogeneously mix two products (or more) while ensuring that one of the products can be precisely measured to guarantee a minimum proportion or quantity of the latter in a precise quantity of the final blend. The seed industry is a prime example of this type of need.

In the seed industry (corn for example), the growing presence of genetically modified organisms (GMO) or genetically modified seeds (GM seeds) (referred to below as a main product) has created the need to implement laws to control environmental integrity. An example of genetic modification was to create a seed containing (into its genome) a common gene known to be toxic to several varieties of predators' larvae. In doing so, the plants themselves were able to produce a toxic protein and thus become resistant to predators (such as insects) without the need for spraying pesticides. To prevent environmental problems (such as insect mutations or insect dissemination), environmental authorities (such as the Environmental Protection Agency, EPA) established regulations concerning the use of these GM seeds. According to these regulations, the farmers were enforced to use a minimum percentage (traditionally 20%) of non-GM seeds, also known as "refuge" or sacrificial seeds (referred to below as an auxiliary product). This practice is intended to prevent the development of organisms resistant to the GM seeds or ensuring that enough organisms not in contact with GM seeds survive to reproduce. At that time, seed producers realized the competitive edge they would get if they succeed in reducing the proportion of regulated refuge seeds. In fact, non-GM seeds are more vulnerable and more likely to generate losses since they are not treated against predators. Consequently, reducing their proportion will reduce the farmers' losses. Advances in this field allow a decrease of the proportion of non-GM seeds (in such cases 5%). The EPA accepted this reduction but regulated that farmers were no longer allowed to make the compliant refuge proportion (blend) themselves. Seed producers were appointed to make the blend, to record production data and to regularly report to the EPA. Then, they started developing (among others) the concept of refuge-in-the-bag (RIB) which provides the right blend (both type of GM and non-GM seeds) based on the refuge percentage required for a particular corn technology. The RIB concept is convenient for farmers because it enables them to plant only one seed product and brings the following benefits: easier planter configuration, less losses, lower operating costs, less manipulation, less proportion errors, more homogeneous fields, etc. . . . ).

In this example, it is understood that there is a product in a first proportion (which is referred to below as the main product) in which will be incorporated added product(s) of a second proportion (referred to below as the auxiliary product).

Weighing equipment used in the bagging process of products that need to be weighed, such as industrial scales, are equipped with a weighing controller that measures the correct weight to be put into each container.

In the present description, it is to be understood that the term "dosing" includes actions of carrying out a measurement (such as weighing, for example) of a product and releasing the product.

The main characteristics required for dosing and blending seeds are summarily presented hereinbelow:

- The system should precisely measure the auxiliary product (in this case by weight) to meet regulatory requirements, such as from the EPA, and the total quantity of the blend (auxiliary product and main product), and record these values to meet economic and market requirements. In order to obtain a precise total weight, the system may vary the main product quantity according to the (previously measured) auxiliary product.
- The proportion of each product in a specific unit should be precisely controlled and may be flexible (it is possible to vary the proportion of each product) in order to meet standards or legal requirements.
- The system should provide a homogeneous blend (evenly distributed) since it is governed by the laws. Moreover, provision of a homogeneous blend allows the use of a portion of a unit (a bag for example) knowing that homogeneity is respected throughout the whole unit.
- The system should record and track the measured auxiliary product as well as record and track the total blend quantity and product proportions of each unit. These data may be compiled to allow the issuance of reports to legal entities if required.
- The system should be compact to be integrated to typical packaging systems, and can be retrofitted to existing packaging systems.
- The system provides increased productivity at a lower cost.

The prior art documents teach that some dosing and blending systems dedicated to dose different products possess some of the characteristics described hereinabove, but none of them adequately meet all of the described requirements. The following summary analysis highlights the weaknesses of the existing dosing and blending systems.

"Mixing before weighing" processes use different means to mix the products before the dosing operation and measure the total product weight. These systems cannot guarantee the proportions of the blend or homogeneity of the blend due to probable segregation happening in the systems between the mixing action and the final weighing. Therefore, "mixing before weighing" is not an adequate solution in contexts and applications where requirements are more strict.

Combination scales (also named multi head weighers) include several weigh pans (up to 24) which perform accurate weighings of one or multiple products, allowing proportion control, recordability and traceability of data. A certain number of these weighings are combined to reach (or to get as close as possible to) the desired weight, which is calculated. However, combination scales cannot guarantee the homogeneity of the blend since they drop the different products together in a filling chute and rely on the falling action to mix the blend. Moreover, for most of the existing packaging plants, these weighers are too large to retrofit the weighing systems already in place.

Dedicated dosing systems (as described in U.S. Pat. No. 7,137,729 B2) can provide a homogeneous blend using a mechanical blender. However, this practice lengthens the system cycle time (thus reducing production rate) and takes up too much place to be integrated with typical compact bagging systems. These systems measure the total product weight, but cannot guarantee the product proportions.

The following table illustrates how the above-mentioned prior art teachings address in part the above needs:

| | Prior art | | |
|---|---|---|---|
| Characteristics | Mixing before weighing | Combination scales | U.S. Pat. No. 7,137,729 |
| Measure auxiliary product/Measure blend | — | — | — |
| Proportion controlled and flexible | — | √ | — |
| Homogeneous blend | — | | √ |
| Record and Track | √ | √ | √ |
| Compact system | — | | |
| Production rates/cost | — | — | — |

Legend:
√ Complete solution
— Partial solution
No solution

Although different dosing systems are already known and satisfy at least one of the above needs, there is still a need for a dosing system which will meet a majority, if not all, of the requirements described above.

SUMMARY OF THE INVENTION

According to the present invention, there is provided a blending scale that is a system for dosing and blending two products consisting of a section for dosing the auxiliary product, a section for feeding the main product and a section for weighing the blend. The blending scale comprises:

- an auxiliary product dosing device for measuring and releasing a defined quantity of the auxiliary product;
- an auxiliary product dispenser receiving the auxiliary product from the auxiliary product dosing device and releasing the auxiliary product within a dynamic unconstrained stream of the main product to produce and maximise a blend of the auxiliary and main products;
- a blend collector for receiving and measuring a quantity of the blend of the auxiliary and main products; and
- a controller for controlling release of the auxiliary product in a synchronized manner with the dynamic unconstrained stream of the main product, based on the defined quantity of the auxiliary product measured by the auxiliary product dosing device, and terminating the dynamic stream of the main product once a targeted quantity of the blend measured by the blend collector is obtained.

Preferably, the present invention measures a defined quantity of the auxiliary product (in this case by weight) and records this value. In other embodiments, the measurements may be done by volume, grain count, particle count, product quantity count or any similar parameter indicative of the quantity of product. The proportion of each product is precisely controlled and may be flexible (it is possible to vary the proportion of each product) in order to meet standards or legal requirements. In fact, in the seed industry for example, a minimal proportion of the auxiliary product is regulated.

Preferably, the present invention provides a homogeneous blend through a dispensing pan which has a controlled opening and a special shape to control the flow and dispersion of the auxiliary product within the dynamic unconstrained stream of the main product. Releasing the auxiliary product in a synchronized manner with the feeding of the main product and properly orient the auxiliary product towards the main product stream helps converge the respective flows of the two products, resulting in a homogeneous (evenly distributed) blend.

Preferably, the present invention precisely measures the total quantity (in this case by weight) of the blend. Since the system had previously measured the auxiliary product, the quantity of the main product is calculated by subtracting the recorded quantity of the auxiliary product from the measured quantity of the blend. In order to obtain a precise total weight, the system may vary the main product quantity according to the (previously measured) auxiliary product.

Preferably, the present invention records and tracks the measured auxiliary product, the total blend quantity as well as each product proportion within each unit. These data may be compiled to allow the issuance of reports to legal entities if required.

Preferably, considering the simplicity of the overall arrangement of the blending scale, the present invention is compact to be integrated to typical packaging systems and may be retrofitted to existing packaging systems.

According to the present invention, there is also provided a method for accurately dosing and homogeneously blending a main product and an auxiliary product comprising the steps of:

a) measuring a parameter indicative of a targeted quantity of the auxiliary product;
b) recording the parameter measured in step a);
c) discharging the auxiliary product towards an auxiliary product dispenser;
d) releasing, through the auxiliary product dispenser, the auxiliary product within a dynamic unconstrained stream of the main product to produce and maximise a blend of the auxiliary and main products, said blend flowing towards a blend collector;
e) feeding the main product into the blend collector until a measured parameter indicative of a targeted quantity of the blend respecting a proportion of the auxiliary product is reached;
f) recording the parameter measured in step e)
g) calculating and recording a proportion of the main product with respect to the auxiliary product in the blend; and
h) discharging the blend towards a downstream equipment for packaging or any other purpose.

Preferably, the method repeats several cycles of steps a) through h).

BRIEF DESCRIPTION OF THE DRAWINGS

These and other objects and advantages of the invention will become apparent upon reading the detailed description and upon referring to the drawings in which.

DETAILED DESCRIPTION OF PREFERRED EMBODIMENTS OF THE INVENTION

Figure 1:
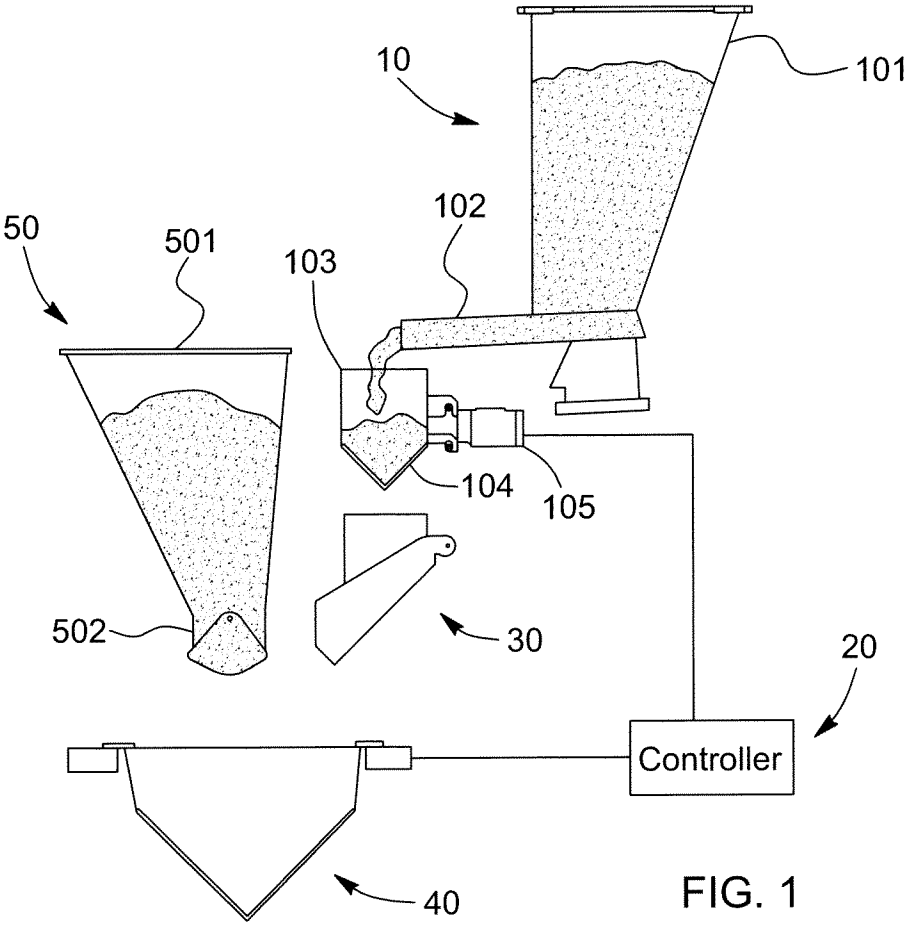
FIG. 1 is a cross-sectional side view of a blending scale according to a preferred embodiment of the present invention, illustrating initial measuring and first recording steps of the method according to a preferred embodiment of the present invention, without a surrounding frame.

According to the present invention, and as shown in FIG. 1, the blending scale is composed of an auxiliary product dosing device 10, a main product feeding system 50, an auxiliary product dispenser 30, a blend collector 40 and a controller 20, preferably a weighing controller for weighing at least one product.

Referring now to FIG. 1, the auxiliary product dosing device 10 is composed of a feeding hopper 101, a feeder 102 and a measuring device 103 for measuring a parameter of the auxiliary product. The auxiliary product is added to the feeding hopper 101 and collects therein. The auxiliary product is then released from the feeding hopper 101 via the feeder 102 to the measuring device 103. In a preferred embodiment, the feeder 102 is a vibratory feeder. The measuring device 103 is a small container with discharge doors 104 which can be suspended by or connected to an apparatus 105 for recording the desired parameter of the auxiliary product. The measuring device 103 sends a signal to the controller 20 to measure the desired parameter of auxiliary product in the measuring device 103 as it enters via the feeder 102. Once the target quantity of the desired parameter of the auxiliary product is achieved, the release of auxiliary product from the feeding hopper 101 is terminated and the target quantity of the desired parameter is recorded. The controller 20 then sends a signal to release the target quantity into the auxiliary product dispenser 30.

Figure 2:
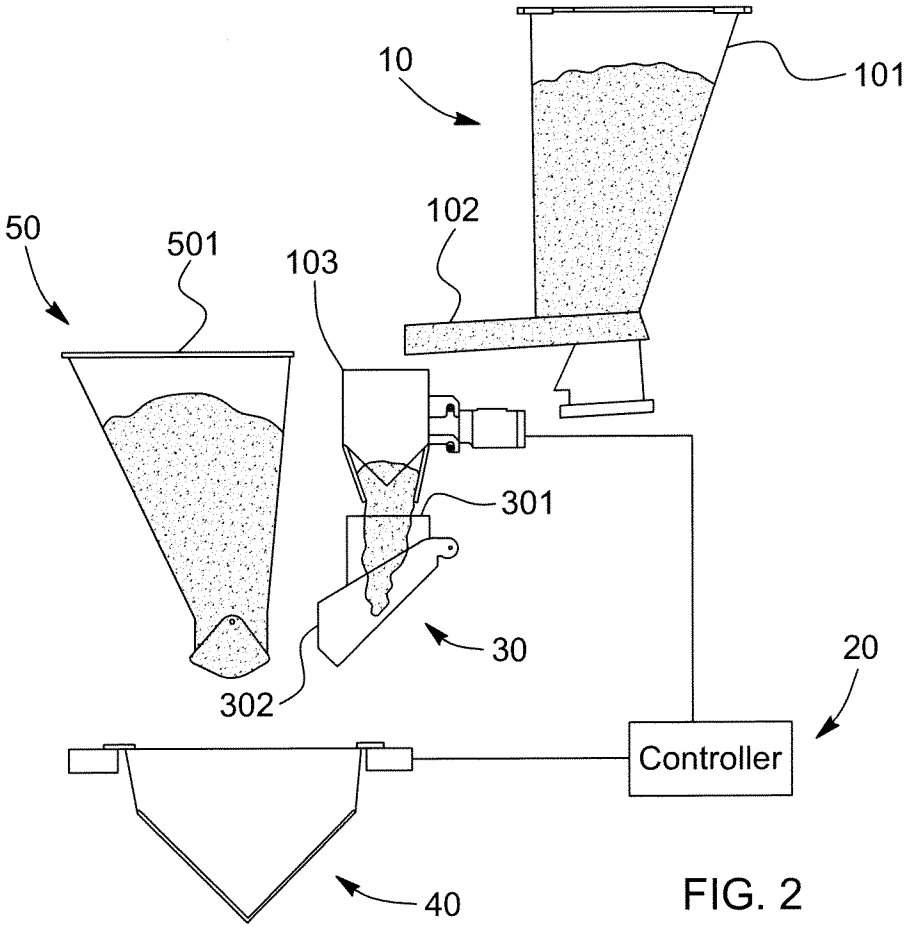
FIG. 2 is a cross-sectional side view of the blending scale shown in FIG. 1, illustrating the first discharging step of the method.
Figure 3:
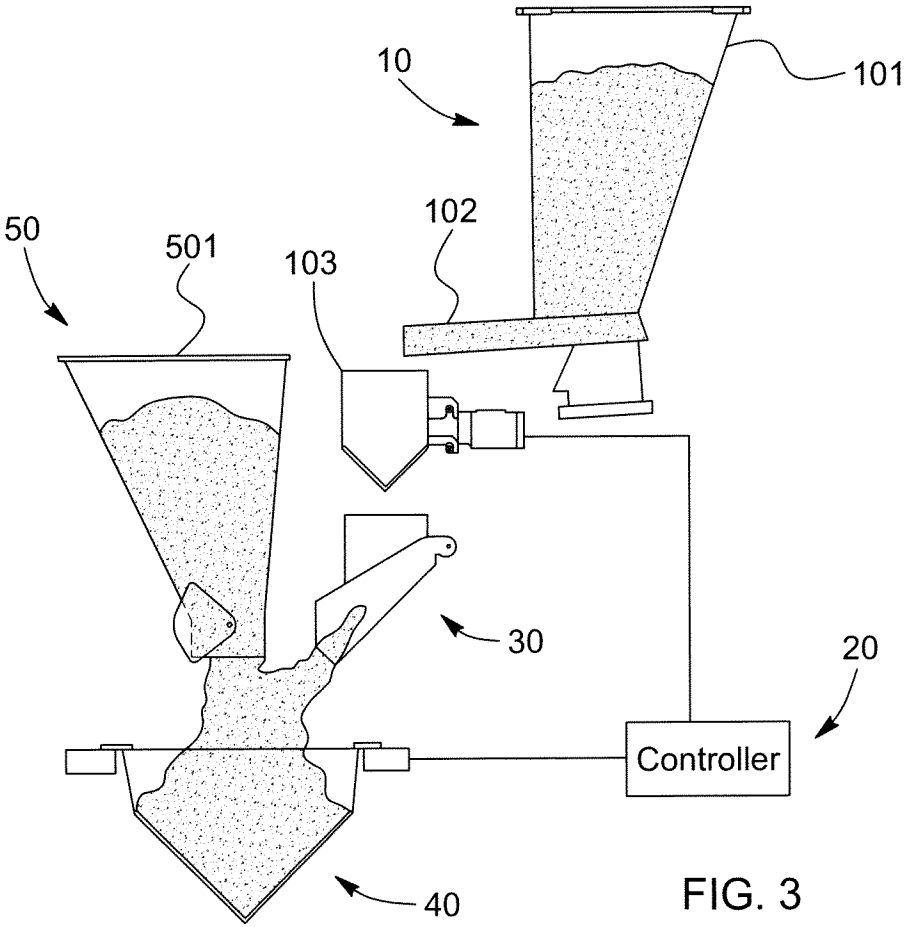
FIG. 3 is a cross-sectional side view of the blending scale shown in FIG. 1, illustrating the main feeding and auxiliary releasing step of the method.
Figure 6:
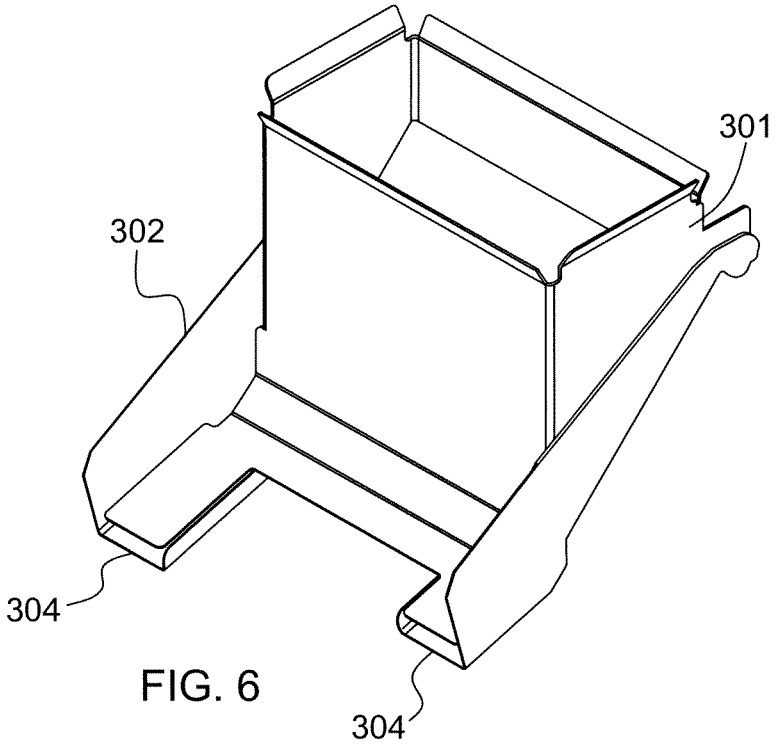
FIG. 6 is a perspective view of an auxiliary product dispenser according to a preferred embodiment of the present invention.
Figure 7:
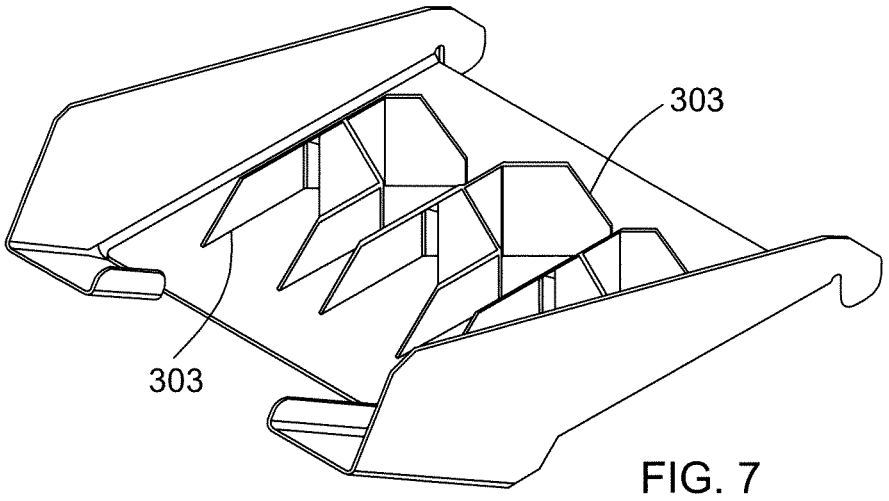
FIG. 7 is a perspective view of a base portion of the auxiliary product dispenser shown in FIG. 6.
Figure 8:
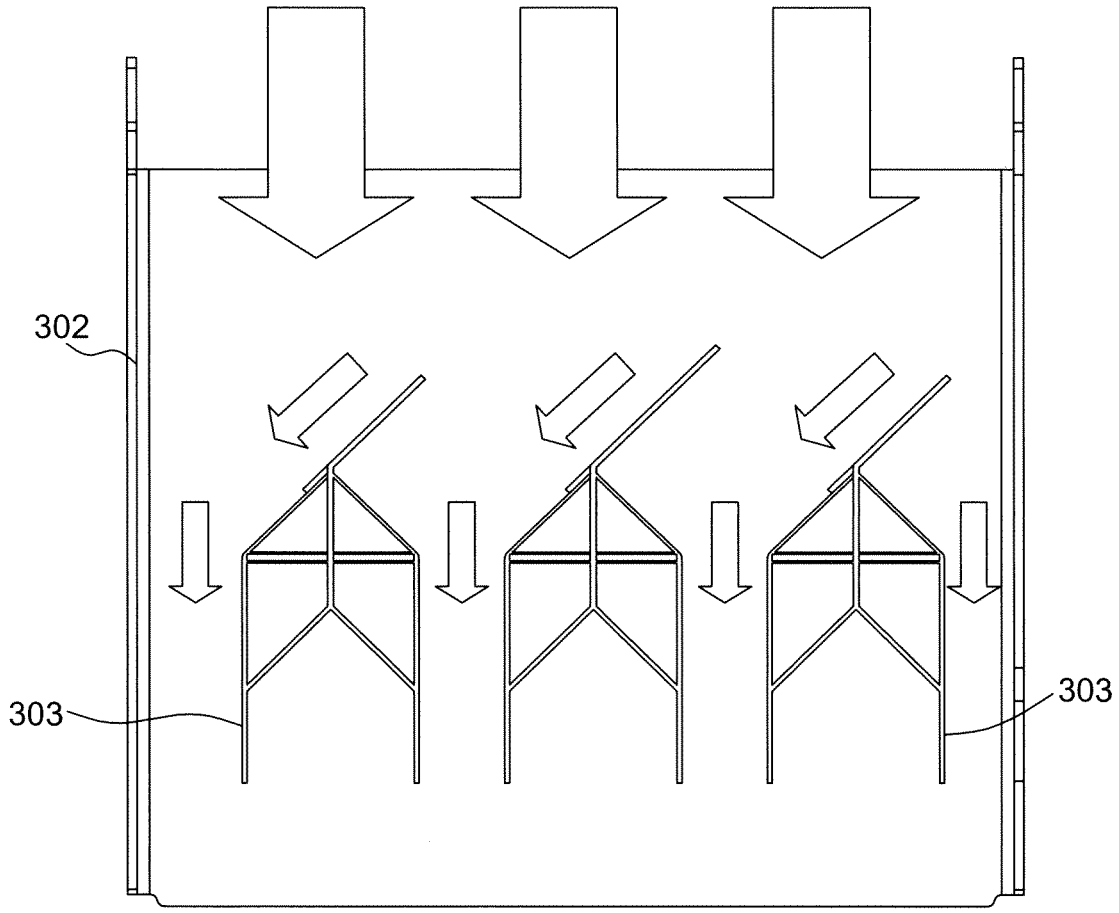
FIG. 8 is a top view of the base portion shown in FIG. 7.

Referring now to FIGS. 1 and 2, the auxiliary product dispenser 30 consists of a conduit with an open inlet 301, and a controllable directional outlet 302 for dispersing the auxiliary product. Preferably, the directional outlet 302 is designed and configured to have an optimal shape so as to maximise the blending of the products in the dynamic unconstrained stream, as better illustrated in FIGS. 6 and 7. The directional outlet 302 comprises dividers 303 to distribute and direct the release of the auxiliary product as it is received from the inlet 301. The directional outlet 302 further comprises at least one adjustable controllable outlet 304 to regulate the auxiliary product flow from the auxiliary product dispenser 30. The auxiliary product dispenser 30 receives through the inlet 301 the target quantity from the auxiliary product dosing device 10. The controller 20 sends a signal to the auxiliary product dispenser to adjust the controllable openings 304 sufficiently so as to dispense the auxiliary product into the dynamic unconstrained stream of the main product released from the main product feeding system 50. As illustrated in FIG. 3, the release of the auxiliary product is synchronized according to the release of the main product, thus optimizing blending and the homogeneity of the blend. It is to be understood that the release of the auxiliary product can be synchronized to match the duration of the release of the main product, or can be varied, to produce blends of variable homogeneity, depending on the desired outcome and application. The homogenous blend collects in the blend collector 40.

Figure 4:
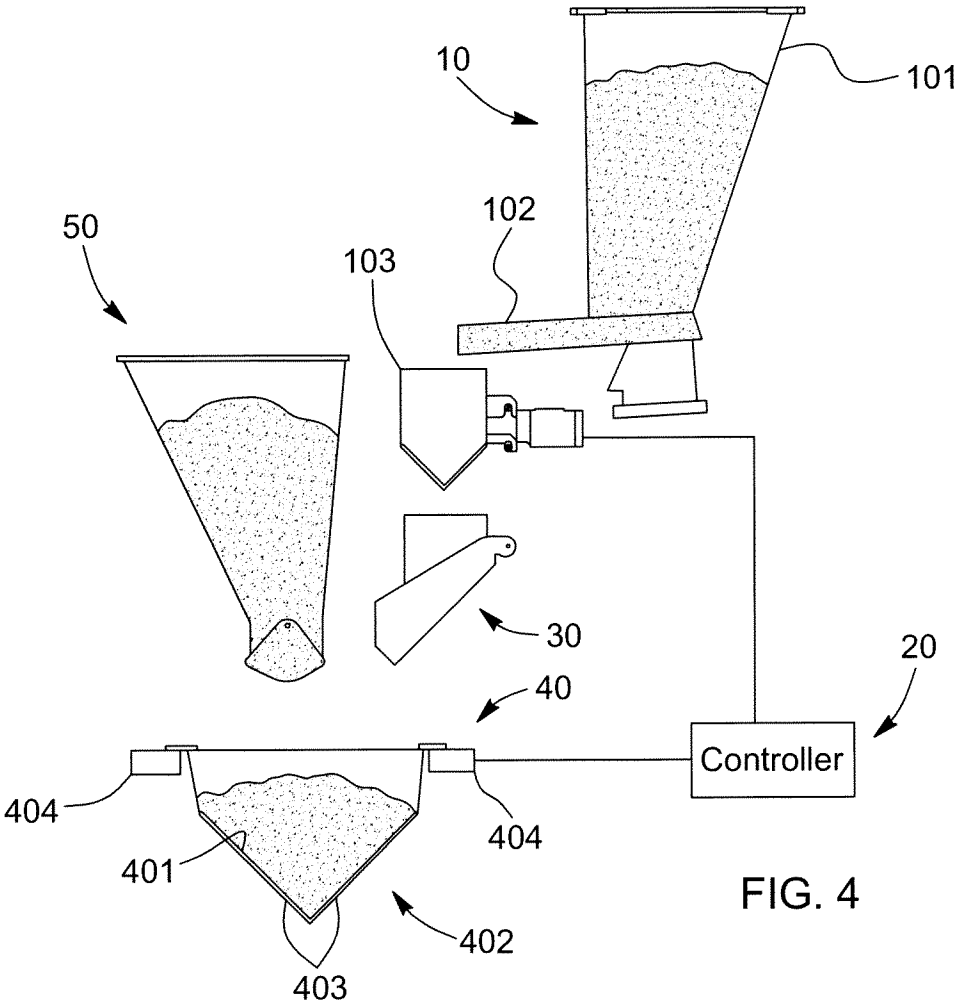
FIG. 4 is a cross-sectional side view of the blending scale shown in FIG. 1 illustrating the second recording and calculating steps of the method.

FIG. 4 shows the homogenous blend in the blend collector 40. The blend collector 40 is a container, preferably a weigh pan 401, with an inlet receiving the blend from the auxiliary product dispenser 30 and the main product feeding system 50. The blend collector 40 has an outlet 402 with discharge doors 403 to release the homogenous blend to a downstream system for packaging or any other purposes. The weigh pan 401 is suspended by or connected to a device 404 for measuring the desired parameter of the auxiliary product. The device 404 sends a signal to the controller 20 to measure the desired parameter of the homogenous blend in the blend collector 40. Once the target quantity of the desired parameter is reached, the controller 20 sends a signal to the main product feeding system 50 to terminate the feeding of the main product. The homogenous blend can then be released via the discharge doors 403 to a downstream system.

The controller 20 is an industrial PLC that receives signals from the auxiliary product dosing device 10 and the blend collector 40 to control the desired parameter of the products (auxiliary product and total blend), records the data and controls all the signals to achieve the correct sequence.

Figure 5:
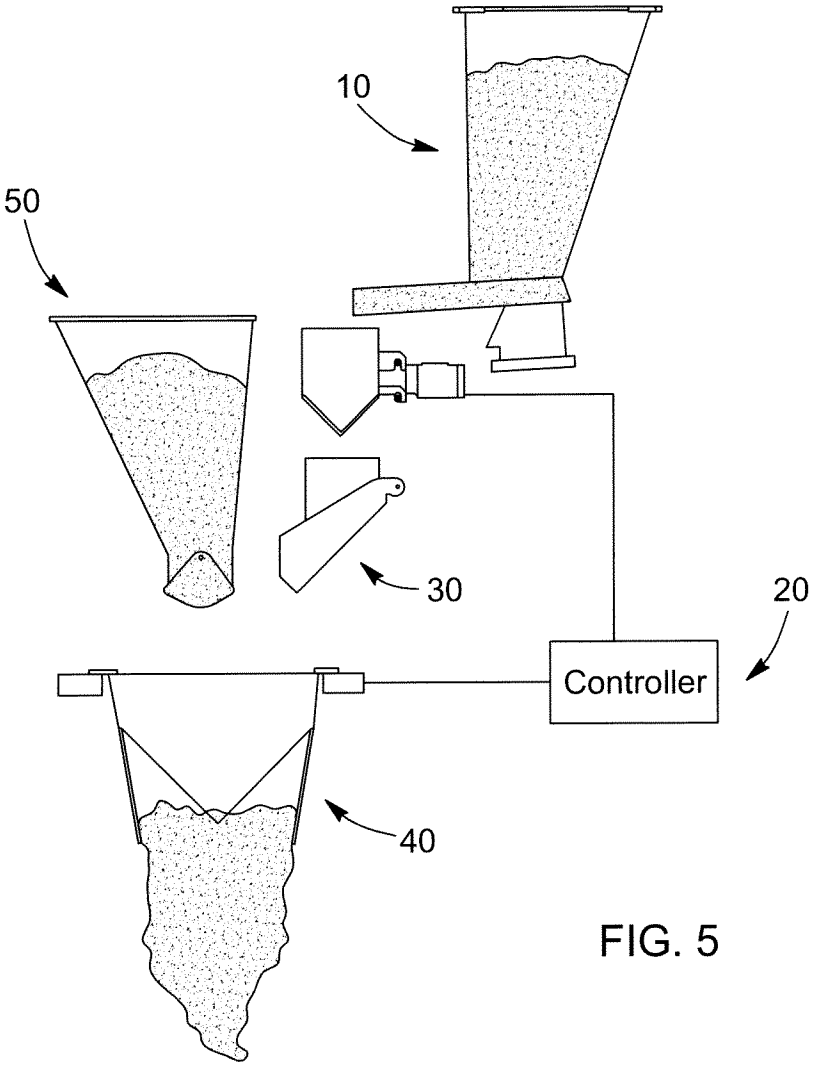
FIG. 5 is a cross-sectional side view of the blending scale shown in FIG. 1 illustrating the second discharging step of the method.

According to the present invention, there is also provided a method for accurately measuring a quantity and homogeneously blending a main product and an auxiliary product comprising the steps of:

a) measuring a parameter indicative of a targeted quantity of the auxiliary product, as shown in FIG. 1;
b) recording the parameter measured in step a);
c) discharging the auxiliary product towards an auxiliary product dispenser, as shown in FIG. 2;
d) releasing, through the auxiliary product dispenser, the auxiliary product within a dynamic unconstrained stream of the main product to produce and maximise a blend of the auxiliary and main products, said blend flowing towards a blend collector, as shown in FIG. 3;
e) feeding the main product into the blend collector until a measured parameter indicative of a targeted quantity of the blend respecting a proportion of the auxiliary product is reached, as shown in FIG. 3;
f) recording the parameter measured in step e), as shown in FIG. 4;
g) calculating and recording a proportion of the main product with respect to the auxiliary product in the blend; and
h) discharging the blend towards a downstream equipment, as shown in FIG. 5.

Preferably, during steps d) and e), steps a) and b) can be performed concurrently so as to prepare for the next cycle of measuring a quantity and homogeneously blending a main product and an auxiliary product.

Preferably, the parameters to be measured by the auxiliary product dosing device 10 and the blend collector 40 can be any one of the following: weight, volume, grain count, particle count, product quality count, or any other similar parameter indicative of a quantity of product.

As would be apparent to a person skilled in the art, the dynamic unconstrained stream consists of the main product free-falling in open air, not encased by a chute, conduit, or other like device, to which is added the auxiliary product according to the quantities and sequence as described above.

Preferably, the main product feeding system 50 is composed of a main feeding hopper 501 and a main feeder 502. In this embodiment, the main feeder 502 is a vertical conduit with a catch gate which opens to release the main product to the blend collector 40 and closes to stop the flow.

Figure 9:
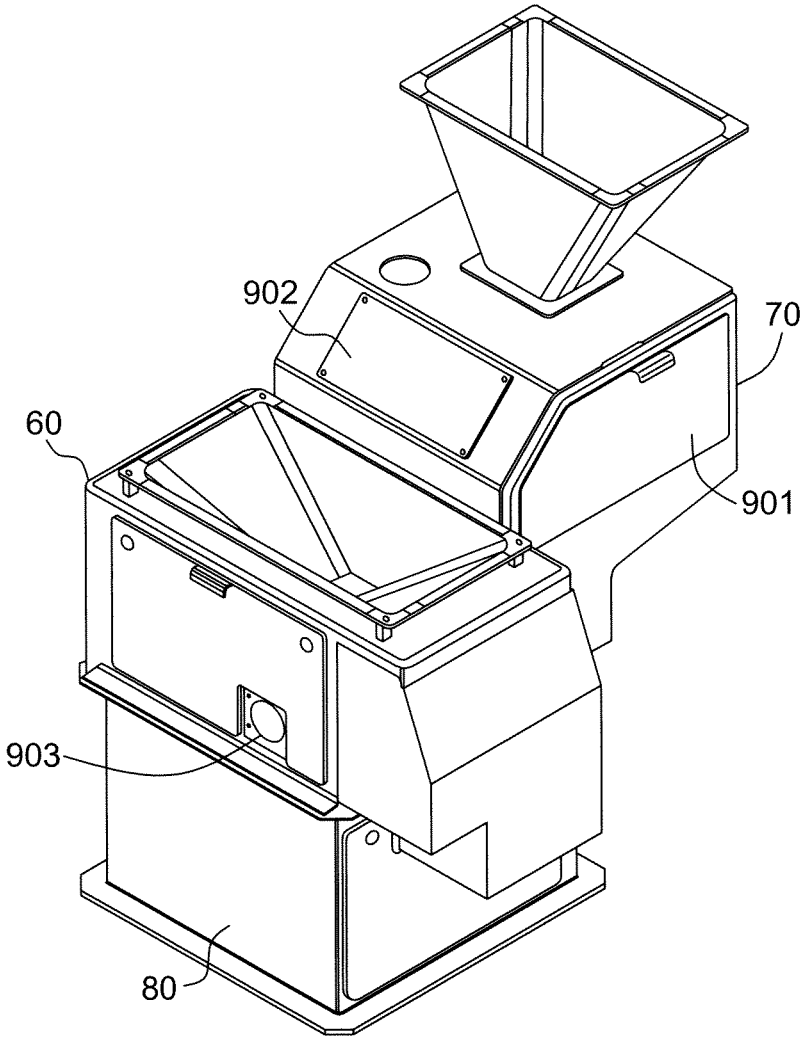
FIG. 9 is a perspective view of the blending scale shown in FIG. 1, with a surrounding frame.

As better illustrated in FIG. 9, the main product feeding system frame 60, the auxiliary product dosing device and auxiliary product dispenser frame 70 and the blend collector frame 80 are connected together and support the different modules comprising the total assembly. There are access doors 901, visual access windows 902 and dust collecting ports 903 strategically located on the frames.

Although preferred embodiments of the present invention have been described in detail herein and illustrated in the accompanying drawings, it is to be understood that the invention is not limited to these precise embodiments and that various changes and modifications may be effected therein without departing from the scope or spirit of the present invention. Furthermore, it is apparent that this invention can apply to many other uses.

The invention claimed is:

1. A blending scale for dosing and blending a main product and an auxiliary product comprising:

a main product feeding system;

an auxiliary product dosing device comprising an auxiliary product feeding hopper and a measuring device including an auxiliary product container with discharge doors, the auxiliary product feeding hopper supplying the auxiliary product container with the auxiliary product and the measuring device weighing a quantity of the auxiliary product contained in the auxiliary product container to obtain a value indicative of a weight of the quantity of the auxiliary product, the discharge doors of the auxiliary product container being configurable in an open configuration for releasing the weighed quantity of the auxiliary product;

an auxiliary product dispenser receiving the auxiliary product from the auxiliary product dosing device and releasing the auxiliary product;

a blend collector comprising a single weigh pan with discharge doors configurable in a closed configuration and an open configuration, said weigh pan being suspended by loadcells, the blend collector with the discharge doors configured in the closed configuration receiving the auxiliary product released from the auxiliary product dispenser and a quantity of the main product from the main product feeding system and weighing a blend of the auxiliary and main products; and a controller operatively connected to the auxiliary product dosing device and the blend collector for recording and tracking the weight obtained by the auxiliary product dosing device with the discharge doors of the auxiliary product container configured in the closed configuration and the weight of the blend of the auxiliary and main products weighed by the blend collector with the discharge doors configured in the closed configuration, the controller also controlling the configuration of the discharge doors of the auxiliary product container and the blend collector between the open configuration and the closed configuration to release of the main and auxiliary products, based on the weight of the auxiliary product weighed by the auxiliary product dosing device, and terminating the release of the main product from the main product feeding system once a targeted quantity of the blend weighed by the blend collector is obtained.

2. The blending scale according to claim 1, wherein the auxiliary product dispenser is configured to release the quantity of the auxiliary product concurrently with a release of the main product so as to produce a homogeneous blend of the auxiliary and main products.

3. The blending scale according to claim 1, further comprising an additional auxiliary product dosing device and auxiliary product dispenser to produce blends of at least three products.

4. The blending scale according to claim 1, further comprising a frame with a security system and an opening to allow visual access and maintenance of at least one of the auxiliary product dosing device, the auxiliary product dispenser and the blend collector.

5. The blending scale of claim 1, wherein the main product feeding system and the auxiliary product dispenser are configured to release the main product and the auxiliary product, respectively, such that the auxiliary product is released within a dynamic unconstrained stream of the main product to produce a blend of the auxiliary and main products.

6. The blending scale according to claim 1, wherein the auxiliary product dispenser comprises an adjustable controllable outlet.

7. The blending scale according to claim 6, wherein the adjustable controllable outlet is configured to regulate a flow of the auxiliary product into the blend collector.

8. The blending scale according to claim 7, wherein the auxiliary product dispenser further comprises an inlet and a plurality of dividers for dispersion of the auxiliary product between said inlet and the adjustable controllable outlet.

9. A blending scale for dosing and blending a main product and an auxiliary product, the blending scale comprising:

a blend collector including a weighing device to weigh a quantity of a blend of the auxiliary product and the main product contained in the blend collector and being selectively configurable in a closed configuration for containing and weighing the quantity of the blend of the auxiliary product and the main product and in a discharge configuration for releasing the quantity of the blend of the auxiliary product and the main product therefrom;

an auxiliary product dosing device including an auxiliary product feeding hopper and a measuring device with an auxiliary product container, the auxiliary product container receiving auxiliary product from the auxiliary product feeding hopper, the measuring device weighing a quantity of the auxiliary product contained in the auxiliary product container and the auxiliary product container being selectively configurable in a closed configuration for containing and weighing the quantity of the auxiliary product and in a discharge configuration for releasing the quantity of the auxiliary product in the blend collector;

a main product feeding system having a feeder selectively configurable in a closed configuration preventing release of the main product and in a discharge configuration for releasing the main product in the blend collector; and a controller operatively connected to the blend collector, the auxiliary product dosing device and the main product feeding system to receive weight data from the weighing device of the blend collector and the measuring device of the auxiliary product dosing device and to send instruction data to configure the blend collector in the discharge configuration based on the weight data received from the weighing device, to configure the auxiliary product container in the discharge configuration based on the weight data received from the measuring device, and to configure the feeder of the main product feeding system selectively in the closed configuration and the discharge configuration based on the weight data received from the weighing device and the measuring device.

10. The blending scale as claimed in claim 9, wherein the auxiliary product container comprises discharge doors, the discharge doors being closed in the closed configuration of the auxiliary product containerand being opened in the discharge configuration of the auxiliary product container.

11. The blending scale as claimed in claim 9, wherein the blend collector comprises a container containing the quantity of the blend of the auxiliary product and the main product, the container having an inlet to receive the auxiliary product from the auxiliary product container and the main product from the main product feeding system and an outlet with discharge doors, the discharge doors being closed in the closed configuration of the blend collector and being opened in the discharge configuration of the blend collector.

12. The blending scale as claimed in claim 9, wherein the main product feeding system further comprises a main product hopper with the feeder operatively connected thereto.

13. The blending scale as claimed in claim 9, wherein the controller sends instructions data to configure the main product feeding system in the closed configuration and the blend collector in the discharge configuration when the weight data received from the weighing device indicates that a predetermined weight is reached.

14. The blending scale as claimed in claim 9, wherein the controller sends instructions data to configure the auxiliary product container and the main product feeding system in the discharge configurations when the weight data received from the measuring device indicates that a predetermined weight is reached.

15. The blending scale as claimed in claim 9, wherein the controller sends instructions data to configure the auxiliary product container and the main product feeding system in the discharge configurations when the weight data received from the measuring device indicates that a predetermined weight is reached and the weight data indicates that the blend collector is substantially empty.

16. The blending scale as claimed in claim 9, wherein the controller sends instructions data to configure the auxiliary product container in the closed configuration when the weight data received from the measuring device indicates that auxiliary product container is substantially empty.

17. The blending scale as claimed in claim 9, wherein the controller sends instructions data to configure the blend collector in the closed configuration when the weight data received from the weighing device indicates that blend collector is substantially empty.

18. The blending scale as claimed in claim 9, wherein the auxiliary product container and the feeder of the main product feeding system are configured concurrently in the discharge configurations with the blend collector being configured in the closed configuration.

19. The blending scale as claimed in claim 9, wherein the auxiliary product container and the feeder of the main product feeding system are configured in the closed configuration when the blend collector is configured in the discharge configuration.

20. The blending scale as claimed in claim 9, further comprising an auxiliary product dispenser mounted between the auxiliary product dosing device and the blend collector, the auxiliary product dispenser receiving the auxiliary product discharged from the auxiliary product dosing device configured in the discharge configuration and dispensing the auxiliary product in the blend collector.

21. The blending scale as claimed in claim 20, wherein the auxiliary product dispenser comprises dividers to distribute and direct the release of the auxiliary product received from the auxiliary product container into the blend collector.

22. The blending scale as claimed in claim 21, wherein the auxiliary product dispenser further comprises an open inlet and a directional outlet including the dividers and at least one adjustable controllable outlet to regulate a flow of the auxiliary product flowing into the blend collector, the open inlet receiving the auxiliary product from the auxiliary product container and directing the auxiliary product into the directional outlet.

23. The blending scale as claimed in claim 9, wherein the auxiliary product feeding hopper is selectively configurable in a non-discharging configuration preventing release of the auxiliary product in the auxiliary product container and in a discharge configuration to release the auxiliary product in the auxiliary product container configured in the closed configuration, the auxiliary product feeding hopper being operatively connected to the controller and being configured in the non-discharge configuration and in the discharge configuration based on the weight data received from the measuring device.

24. The blending scale as claimed in claim 23, wherein the controller sends instructions data to configure the auxiliary product feeding hopper in the discharge configuration when the weight data received from the measuring device indicates that the auxiliary product container is substantially empty and in the closed configuration when the weight data received from the measuring device indicates that a predetermined weight is reached.

25. The blending scale as claimed in claim 23, wherein the auxiliary product feeding hopper is configured in the discharge configuration when the auxiliary product container is in the closed configuration and the auxiliary product feeding hopper is configured in the closed configuration when the auxiliary product container is in the discharge configuration.

26. A blending scale for dosing and blending a main product and an auxiliary product, the blending scale comprising:

a blend collector comprising a blend collector container having an outlet with discharge doors and a weighing device to weigh a quantity of a blend of the auxiliary product and the main product contained in the blend collector container, the discharge doors being selectively configurable in a closed configuration for containing and weighing the quantity of the blend of the auxiliary product and the main product contained in the blend collector container and in a discharge configuration for releasing a targeted quantity of the blend of the auxiliary product and the main product therefrom;

an auxiliary product dosing device comprising an auxiliary product feeding hopper containing the auxiliary product and a measuring device including an auxiliary product container with discharge doors, the auxiliary product container receiving the auxiliary product from the auxiliary product feeding hopper, the measuring device being configured to weigh a quantity of the auxiliary product contained in the auxiliary product container, the discharge doors being selectively configurable in a closed configuration for containing and weighing the quantity of the auxiliary product contained in the auxiliary product container and in a discharge configuration for releasing a targeted quantity of the auxiliary product in the blend collector;

a main product feeding system having a feeder with a catch gate selectively configurable in a closed configuration preventing release of the main product from the feeder and in a discharge configuration for releasing the main product in the blend collector; and a controller operatively connected to the blend collector, the auxiliary product dosing device and the main product feeding system to receive weight data from the weighing device of the blend collector and the measuring device of the auxiliary product dosing device and to send instruction data to configure the discharge doors of the blend collector in the discharge configuration based on the weight data received from the weighing device, to configure the discharge doors of the auxiliary product container in the discharge configuration based on the weight data received from the measuring device, and to configure the catch gate of the feeder of the main product feeding system selectively in the closed configuration and the discharge configuration based on the weight data received from the weighing device and the measuring device.

* * * * *